US006745877B1

(12) United States Patent
Tsai

(10) Patent No.: US 6,745,877 B1
(45) Date of Patent: Jun. 8, 2004

(54) LUGGAGE HAVING A HIDDEN TYPE PULL HANDLE

(76) Inventor: Yen-Lung Tsai, P.O. Box 55-124, Taichung (TW)

( * ) Notice: Subject to any disclaimer, the term of this patent is extended or adjusted under 35 U.S.C. 154(b) by 0 days.

(21) Appl. No.: 10/352,050

(22) Filed: Jan. 28, 2003

(51) Int. Cl.[7] ..... A45C 5/14; A45C 13/26

(52) U.S. Cl. ..... 190/115; 190/18 A; 190/24; 190/39; 190/127

(58) Field of Search ..... 190/18 R, 18 A, 190/24, 39, 109, 115, 127

(56) References Cited

U.S. PATENT DOCUMENTS

| | | | | | |
|---|---|---|---|---|---|
| 2,779,371 | A | * | 1/1957 | Klehr | 190/18 R |
| 3,920,408 | A | * | 11/1975 | Holtzman et al. | 428/572 |
| 4,669,587 | A | * | 6/1987 | Zitt | 190/109 |
| 5,031,734 | A | * | 7/1991 | King | 190/122 |
| 5,431,428 | A | * | 7/1995 | Marchwiak et al. | 190/18 A |
| 5,482,147 | A | * | 1/1996 | Wang | 190/115 |
| 5,498,010 | A | * | 3/1996 | Stube | 280/37 |
| 5,575,361 | A | * | 11/1996 | Chou | 190/18 A |
| 5,634,538 | A | * | 6/1997 | Tsai | 190/18 A |
| 5,782,325 | A | * | 7/1998 | O'Shea et al. | 190/18 A |
| 5,794,744 | A | * | 8/1998 | Lin | 190/18 A |
| 5,833,039 | A | * | 11/1998 | Kotkins, Jr. | 190/115 |
| 5,875,876 | A | * | 3/1999 | Wang | 190/18 A |
| 5,890,570 | A | * | 4/1999 | Sadow | 190/18 A |
| 5,918,710 | A | * | 7/1999 | Sher | 190/18 A |
| 5,950,779 | A | * | 9/1999 | Miyoshi | 190/18 A |
| 6,062,356 | A | * | 5/2000 | Nykoluk | 190/18 R |
| 6,062,357 | A | * | 5/2000 | Bogert | 190/18 A |
| 6,098,768 | A | * | 8/2000 | Tsai | 190/18 A |
| 6,109,404 | A | * | 8/2000 | Bishop | 190/125 |
| 6,113,196 | A | * | 9/2000 | Kuo | 301/120 |
| 6,167,994 | B1 | * | 1/2001 | Kuo et al. | 190/18 A |
| 6,186,295 | B1 | * | 2/2001 | Lin et al. | 190/18 A |
| 6,283,261 | B1 | * | 9/2001 | Sher | 190/122 |

FOREIGN PATENT DOCUMENTS

| | | | | |
|---|---|---|---|---|
| FR | 1563534 | * | 4/1969 | 190/18 A |
| JP | 408336412 A | * | 12/1996 | |

* cited by examiner

*Primary Examiner*—Sue A. Weaver

(57) ABSTRACT

A luggage having a hidden type pull handle includes a main body, a telescopic pull handle, and two roller sets. Each of the two roller sets includes a wheel seat, a roller, and a reinforcement member. The pull handle is retained on the middle partition of the main body. Thus, when the pull handle is pulled in an oblique manner, the pull handle directly forces the main space of the main body to lean, so that the shell around the periphery of the secondary space of the main body is not pulled by the pull handle, thereby preventing the main body from being torn out, so as to increase the lifetime of the main body.

19 Claims, 8 Drawing Sheets

LUGGAGE HAVING A HIDDEN TYPE PULL HANDLE

BACKGROUND OF THE INVENTION

1. Field of the Invention

The present invention relates to a luggage having a hidden type pull handle, and more particularly to a luggage, wherein the pull handle can be retracted into and hidden in the secondary space of the main body, thereby decreasing the volume of the luggage, and thereby protecting the pull handle.

2. Description of the Related Art

A first conventional luggage in accordance with the prior art shown in FIG. 1 comprises a main body 1, a pull handle 2, two rollers 3 and two wheel seats 4. However, the pull handle 2 protrudes outward from the main body 1, so that the luggage has a larger volume and occupies a larger space, thereby causing inconvenience in storage, package and transportation. In addition, the pull handle 2 is easily broken due to hit.

A second conventional luggage in accordance with the prior art shown in FIGS. 2 and 3 comprises a main body 5, a retractable pull handle 6, and two rollers 7. The main body 5 includes a main space 8 and a secondary space 9. The main body 5 also includes a shell 502, and a zipper 508. The pull handle 6 is retractably mounted on the main body 5, so that the pull handle 6 can be retracted into and hidden in the main body 5. The pull handle 6 has a lower end secured on a support plate (not shown) in the shell 502 of the main body 5. Thus, when the pull handle 6 is pulled, the pull handle 6 applies a pulling force on the support plate in the shell 502 of the main body 5, so that the shell 502 located at the secondary space 9 of the main body 5 is easily torn out or broken during a long-term of utilization.

A third conventional luggage in accordance with the prior art shown in FIG. 4 comprises a main body having a main space 8' and a secondary space 9'. The secondary space 9' has a zipper 508' extending to the two sides of the secondary space 9', so that the secondary space 9' can be fully opened to increase the storage space. However, when the zipper 508' is fully opened, the combining force between the main space 8' and the secondary space 9' is greatly reduced, so that the main space 8' and the secondary space 9' lean toward the opposite directions, thereby causing inconvenience in use.

SUMMARY OF THE INVENTION

The present invention is to mitigate and/or obviate the disadvantage of the conventional luggage.

The primary objective of the present invention is to provide a luggage having a hidden type pull handle, wherein the pull handle is retained on the middle partition of the main body. Thus, when the pull handle is pulled in an oblique manner, the pull handle directly forces the main space of the main body to lean, so that the shell around the periphery of the secondary space of the main body is not pulled by the pull handle, thereby preventing the main body from being torn out, so as to increase the lifetime of the main body.

Another objective of the present invention is to provide a luggage having a hidden type pull handle, wherein the arcuate guard plate of the wheel seat is extended to the outer side of the main space and the secondary space of the main body, thereby supporting, strengthening and protecting the main space and the secondary space of the main body, so that the main body has a better structural strength.

A further objective of the present invention is to provide a luggage having a hidden type pull handle, wherein the wheel seats and the support members are combined with the support plate, so as to support the main body rigidly and stably, so that the main body will not lean when the user is taking out the articles in the main body.

A further objective of the present invention is to provide a luggage having a hidden type pull handle, wherein the pull handle can be retracted into and hidden in the secondary space of the main body, thereby decreasing the volume of the luggage, and thereby protecting the pull handle.

In accordance with the present invention, there is provided a luggage having a hidden type pull handle, comprising a main body, a telescopic pull handle, and two roller sets, wherein:

- the main body has an inner portion provided with a middle partition which divides the inner portion of the main body into a main space and a secondary space, the main space of the main body has a bottom provided with a support plate;
- the pull handle is mounted in the secondary space of the main body and supported on the middle partition of the main body;
- each of the two roller sets is mounted on the bottom of the main body and includes a wheel seat, a roller, and a reinforcement member, wherein:
- the wheel seat includes an arcuate guard plate and an upright plate, the wheel seat is mounted on the bottom of the main body, with the corner of the bottom of the main body being encompassed by the arcuate guard plate and the upright plate of the wheel seat;
- the roller is rotatably mounted on the wheel seat; and
- the reinforcement member is mounted in the secondary space of the main body, with the comer of the bottom of the main body being sandwiched and clamped between the arcuate guard plate, the upright plate and the reinforcement member.

Further benefits and advantages of the present invention will become apparent after a careful reading of the detailed description with appropriate reference to the accompanying drawings.

DETAILED DESCRIPTION OF THE INVENTION

Figure 1:
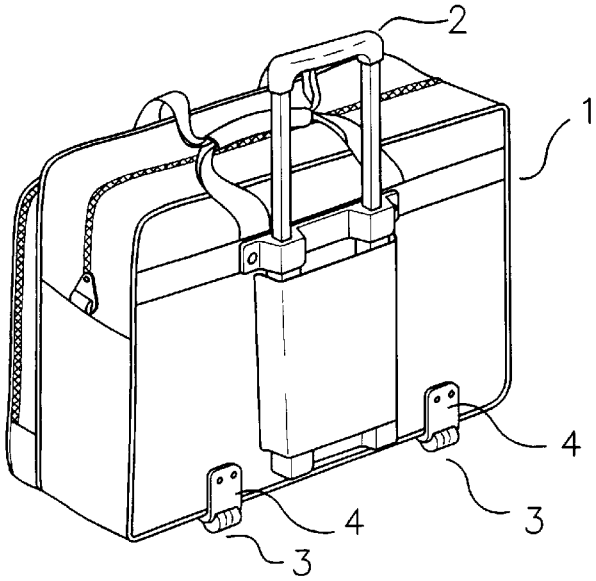
FIG.1 PRIOR ART
FIG. 1 is a perspective view of a first conventional luggage in accordance with the prior art.
Figure 2:
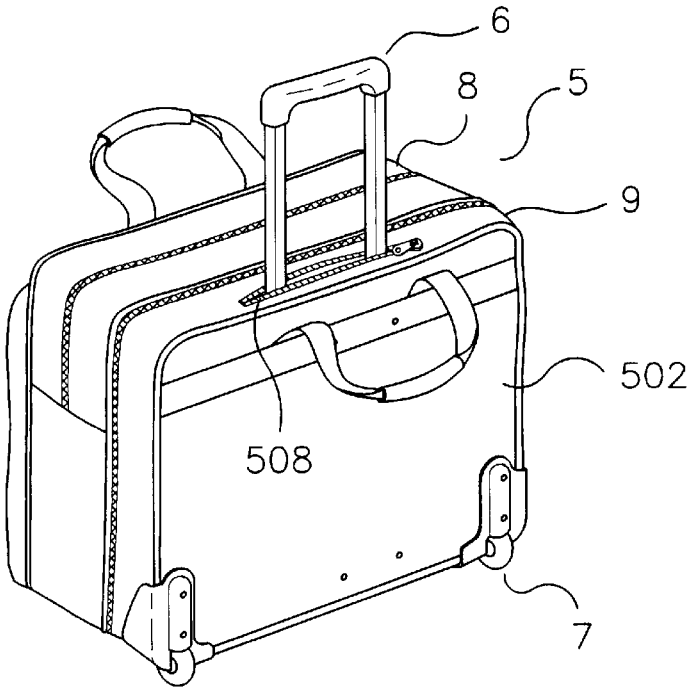
FIG.2 PRIOR ART
FIG. 2 is a perspective view of a second conventional luggage in accordance with the prior art.
Figure 3:
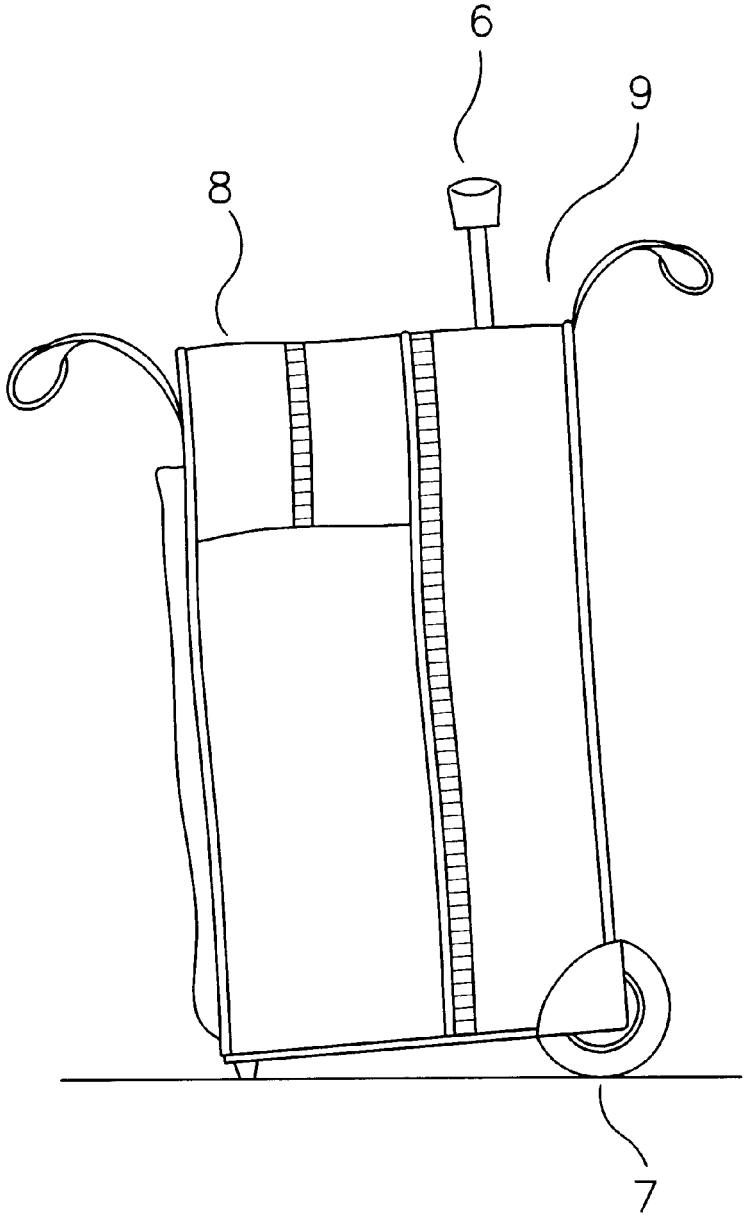
FIG.3 PRIOR ART
FIG. 3 is a side plan view of the second conventional luggage in accordance with the prior art.
Figure 4:
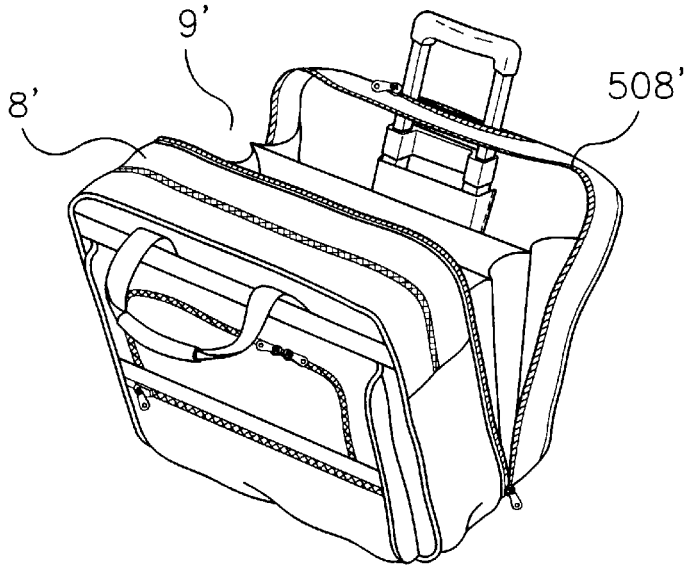
FIG.4 PRIOR ART
FIG. 4 is a perspective view of a third conventional luggage in accordance with the prior art.

Referring to the drawings and initially to FIGS. 5–9, a luggage having a hidden type pull handle in accordance with a first embodiment of the present invention comprises a main body 10, a telescopic pull handle 20, and two roller sets 30.

The main body 10 has an inner portion provided with a middle partition 12 which divides the inner portion of the main body 10 into a main space 11 and a secondary space 13. Each of the main space 11 and the secondary space 13 of the main body 10 has a top provided with a zipper 14. The zipper 14 has two ends extended to the two sides of each of the main space 11 and the secondary space 13 of the main body 10 respectively, thereby facilitating opening and closing of the main space 11 and the secondary space 13.

The main space 11 of the main body 10 has a bottom provided with a support plate 15 made of solid material to provide a support effect for supporting the heavy weight contained in the main body 10. A forming plate 16 is mounted on a bottom of the support plate 15, and is extended to a bottom of the secondary space 13 of the main body 10. The forming plate 16 has two sides each formed with an arcuate shape so as to confine the main body 10. The secondary space 13 of the main body 10 is bonded with a plurality of receiving pockets 134 for receiving smaller articles.

The pull handle 20 is a one-shaft pull handle mounted in the secondary space 13 of the main body 10 and supported on the middle partition 12 of the main body 10. The pull handle 20 has a bottom provided with a substantially L-shaped seat plate 22. The seat plate 22 is extended through a bottom of the middle partition 12 and is fixed on the support plate 15.

The middle partition 12 is provided with a connecting plate 122 made of solid material. A fixing seat 24 is mounted on the pull handle 20, and is fixed on the connecting plate 122, to position the pull handle 20 in the secondary space 13 of the main body 10.

Figure 7:
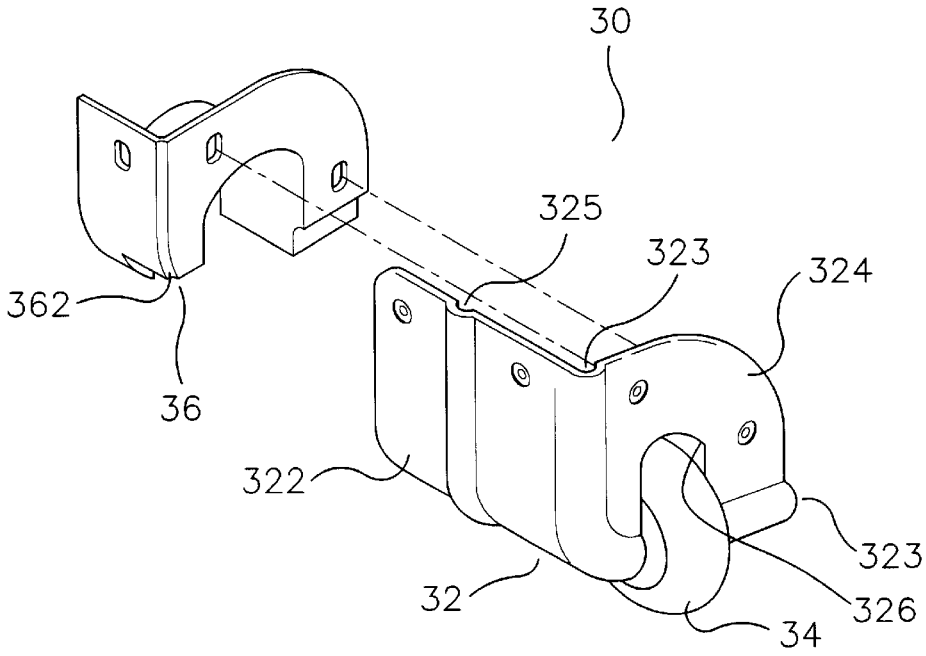
FIG. 7 is an exploded perspective view of a roller set of the luggage having a hidden type pull handle in accordance with the first embodiment of the present invention.

Each of the two roller sets 30 is mounted on the bottom of the main body 10. As shown in FIG. 7, each of the two roller sets 30 includes a wheel seat 32, a roller 34, and a reinforcement member 36.

The wheel seat 32 is made of a fiber reinforced plastic material. The wheel seat 32 is substantially L-shaped, and includes an arcuate guard plate 322 and an upright plate 324. The arcuate guard plate 322 is integrally formed with the upright plate 324. The upright plate 324 has a bottom formed with a pivot slot 326.

The roller 34 is rotatably mounted on the wheel seat 32. Preferably, the roller 34 is rotatably mounted in the pivot slot 326 of the wheel seat 32.

The reinforcement member 36 is made of a fiber reinforced plastic material.

Figure 5:
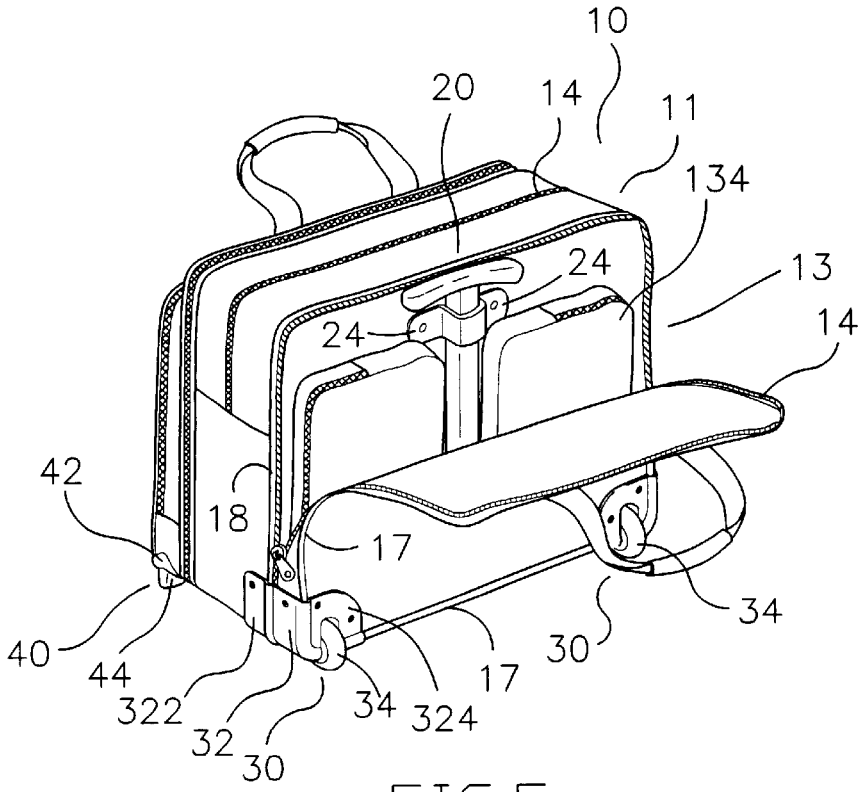
FIG. 5 is a perspective view of a luggage having a hidden type pull handle in accordance with a first embodiment of the present invention.
Figure 6:
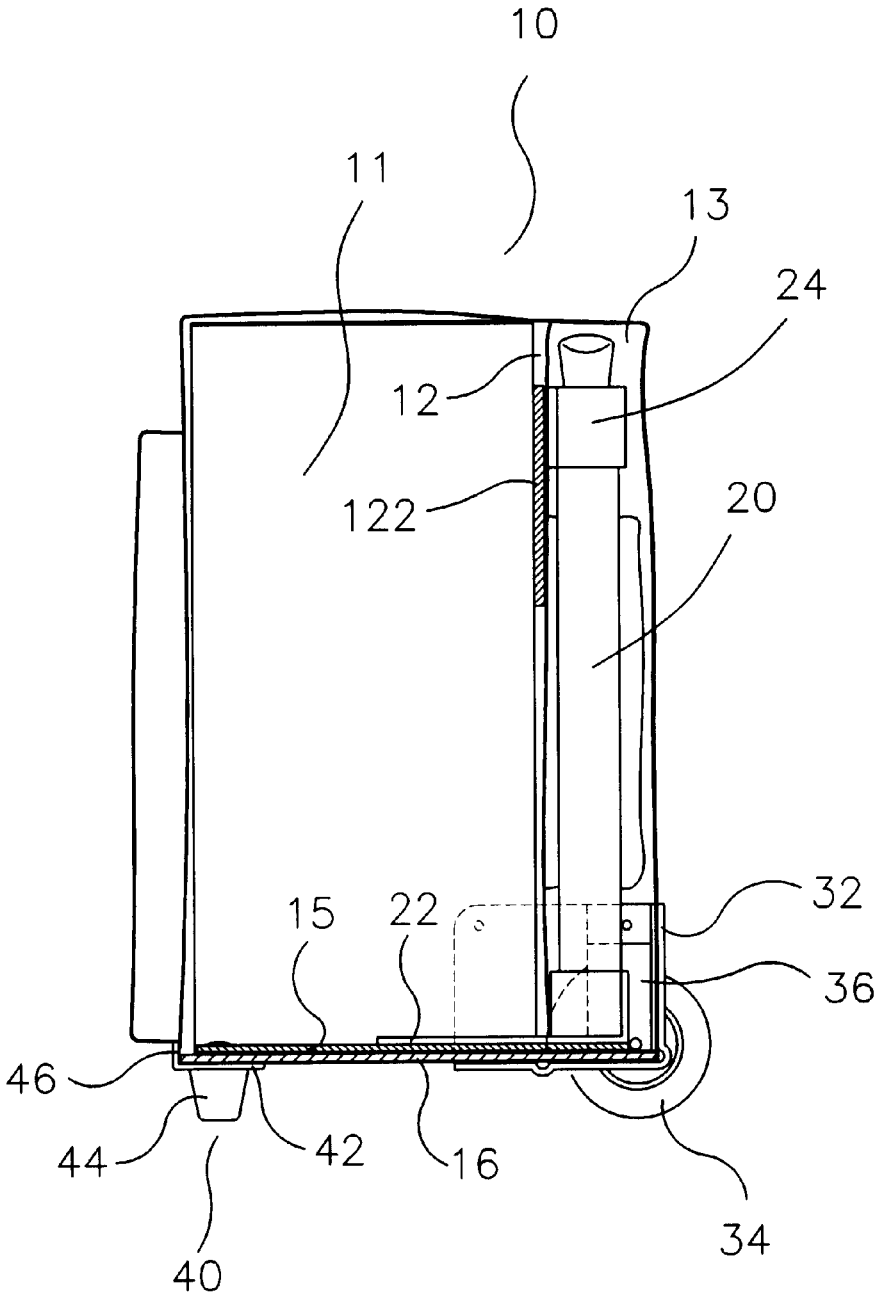
FIG. 6 is a side plan cross-sectional view of the luggage having a hidden type pull handle in accordance with the first embodiment of the present invention.

Referring to FIGS. 5–7, the wheel seat 32 of each of the two roller sets 30 is mounted on the bottom of the main body 10, with the corner of the bottom of the main body 10 being encompassed by the arcuate guard plate 322 and the upright plate 324 of the wheel seat 32. The arcuate guard plate 322 of the wheel seat 32 of each of the two roller sets 30 is extended to the outer side of the main space 11 and the secondary space 13 of the main body 10. The reinforcement member 36 of each of the two roller sets 30 is mounted in the secondary space 13 of the main body 10, with the corner of the bottom of the main body 10 being sandwiched and clamped between the arcuate guard plate 322, the upright plate 324 and the reinforcement member 36.

Preferably, the arcuate guard plate 322, the upright plate 324 and the reinforcement member 36 are combined with each other, and the arcuate guard plate 322 is combined with the support plate 15 and the forming plate 16, thereby supporting, strengthening and protecting the main space 11 and the secondary space 13 of the main body 10.

In addition, the secondary space 13 of the main body 10 has a periphery formed with a first piping 17, the wheel seat 32 has an inner wall formed with a first insertion groove 323, and the reinforcement member 36 has an outer wall formed with a second insertion groove 362 combined with the first insertion groove 323 of the wheel seat 32 to form a tubular space for receiving the first piping 17 of the secondary space 13 of the main body 10. In addition, the middle partition 12 of the main body 10 has a periphery formed with a second piping 18, and the arcuate guard plate 322 has an inner wall formed with a third insertion groove 325 for receiving the second piping 18 of the middle partition 12 of the main body 10. In such a manner, the distance between the first piping 17 and the second piping 18 is maintained at a constant, thereby preventing the secondary space 13 of the main body 10 from being compressed.

Figure 8:
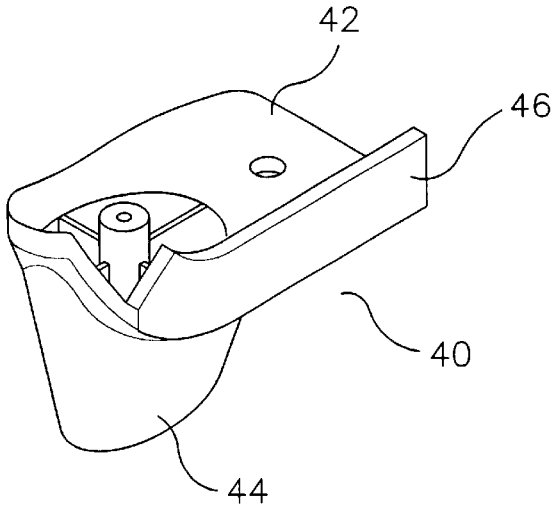
FIG. 8 is a perspective view of a support member of the luggage having a hidden type pull handle in accordance with the first embodiment of the present invention.

Referring to FIGS. 5, 6 and 8, the luggage further comprises two support members 40 each mounted on the bottom of the main body 10 and each located opposite to the respective roller set 30. Each of the two support members 40 is made of a fiber reinforced plastic material. Each of the two support members 40 includes a base plate 42 mounted on the bottom of the main body 10, a foot post 44 mounted on the bottom of the base plate 42, and a front catch plate 46 mounted on a front side of the base plate 42. The base plate 42 and the foot post 44 are combined with the support plate 15 so as to position each of the two support members 40 on the bottom of the main body 10. The base plate 42 and the front catch plate 46 encompass the comer of the bottom of the main body 10 so as to protect the bottom of the main body 10.

Figure 9:
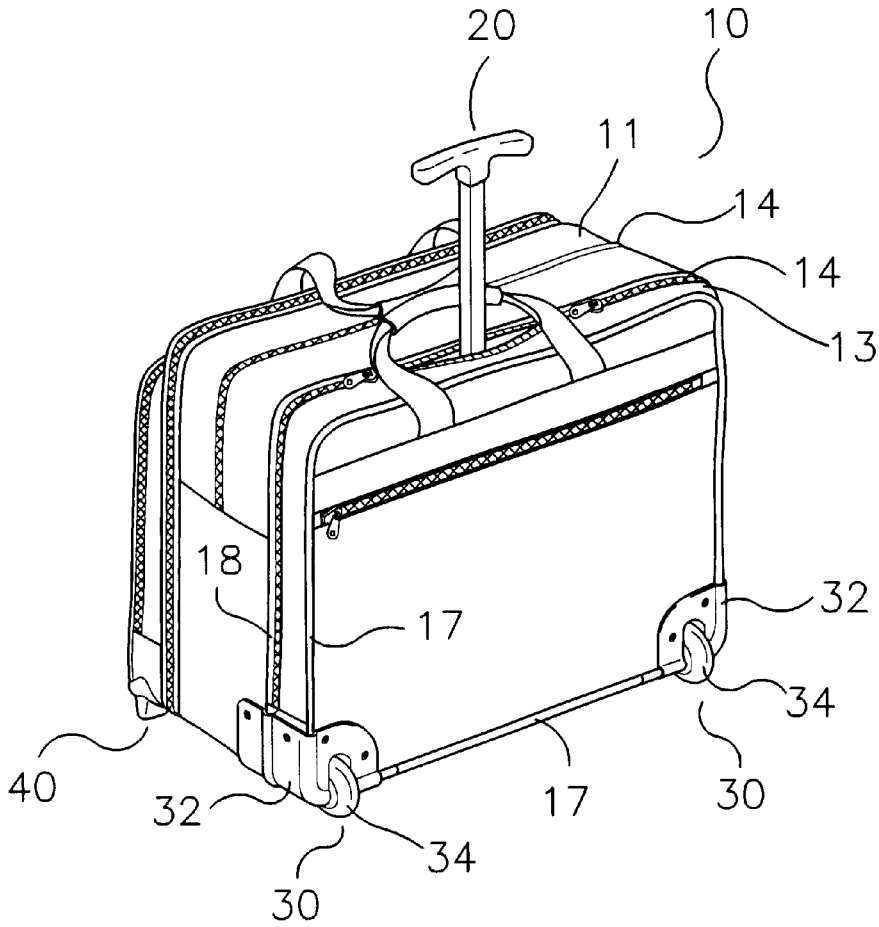
FIG. 9 is a perspective view of the luggage having a hidden type pull handle in accordance with the first embodiment of the present invention.

In practice, the zipper 14 on the secondary space 13 of the main body 10 is opened, so that the pull handle 20 can be pulled outward for use as shown in FIG. 9. In such a manner, the pull handle 20 is retained on the middle partition 12 of the main body 10. Thus, when the pull handle 20 is pulled in an oblique manner, the pull handle 20 directly forces the main space 11 of the main body 10 to lean, so that the shell around the periphery of the secondary space 13 of the main body 10 is not pulled by the pull handle 20, thereby preventing the main body 10 from being torn out, so as to increase the lifetime of the main body 10.

In addition, the arcuate guard plate 322 of the wheel seat 32 is extended to the outer side of the main space 11 and the secondary space 13 of the main body 10, thereby supporting, strengthening and protecting the main space 11 and the secondary space 13 of the main body 10, so that the main body 10 has a better structural strength.

Further, the wheel seats 32 and the support members 40 are combined with the support plate 15, so as to support the main body 10 rigidly and stably, so that the main body 10 will not lean when the user is taking out the articles in the main body 10.

Further, the pull handle 20 can be retracted into and hidden in the secondary space 13 of the main body 10, thereby decreasing the volume of the luggage, and thereby protecting the pull handle 20.

Figure 10:
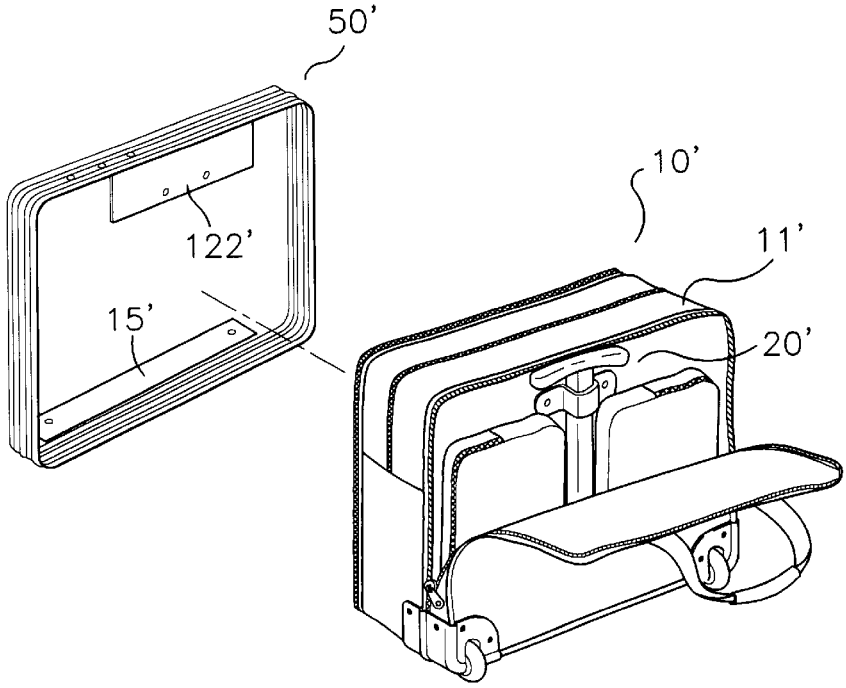
FIG. 10 is a partially exploded perspective view of the luggage having a hidden type pull handle in accordance with the second embodiment of the present invention.

Referring to FIG. 10, the luggage having a hidden type pull handle in accordance with the second embodiment of the present invention is shown, wherein the luggage further comprises a frame 50' mounted in the main space 11' of the main body 10'. The frame 50' is connected to the support plate 15' and the connecting plate 122' of the main body 10' for positioning the pull handle 20'.

Figure 11:
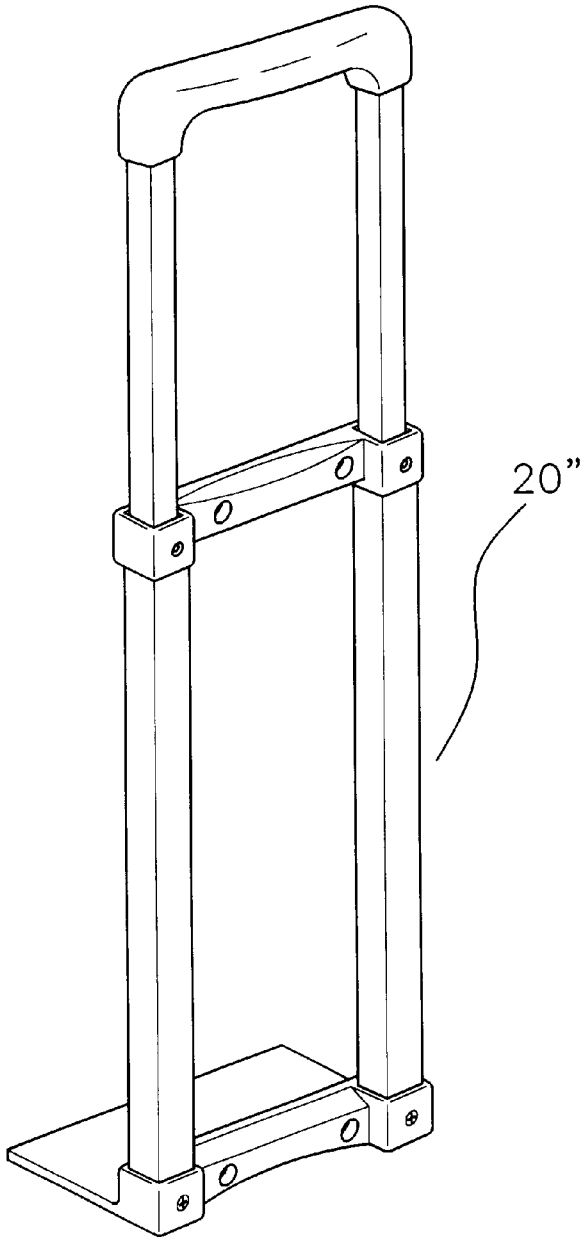
FIG. 11 is a perspective view of a pull handle of the luggage having a hidden type pull handle in accordance with the third embodiment of the present invention.

Referring to FIG. 11, the luggage having a hidden type pull handle in accordance with the third embodiment of the present invention is shown, wherein the pull handle 20" is a two-shaft pull handle.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A luggage having a hidden type pull handle, comprising a main body, a telescopic pull handle, and two roller sets, wherein:

the main body has an inner portion provided with a middle partition which divides the inner portion of the main body into a main space and a secondary space, the main space of the main body has a bottom provided with a support plate;

the pull handle is mounted in the secondary space of the main body and supported on the middle partition of the main body;

the pull handle has a bottom provided with a substantially L-shaped seat plate extended through a bottom of the middle partition and fixed on the support plate;

each of the two roller sets is mounted on the bottom of the main body and includes a wheel seat, a roller, and a reinforcement member, wherein:

the wheel seat includes an arcuate guard plate and an upright plate, the wheel seat is mounted on the bottom of the main body, with the corner of the bottom of the main body being encompassed by the arcuate guard plate and the upright plate of the wheel seat;

the roller is rotatably mounted on the wheel seat; and the reinforcement member is mounted in the secondary space of the main body, with the corner of the bottom of the main body being sandwiched and clamped between the arcuate guard plate, the upright plate and the reinforcement member.

2. The luggage having a hidden type pull handle in accordance with claim 1, wherein each of the main space and the secondary space of the main body has a top provided with a zipper which has two ends extended to the two sides of each of the main space and the secondary space of the main body respectively.

3. The luggage having a hidden type pull handle in accordance with claim 1, wherein the main body includes a forming plate mounted on a bottom of the support plate and extended to a bottom of the secondary space of the main body.

4. The luggage having a hidden type pull handle in accordance with claim 3, wherein the arcuate guard plate, the upright plate and the reinforcement member are combined with each other, and the arcuate guard plate is combined with the support plate and the forming plate.

5. The luggage having a hidden type pull handle in accordance with claim 1, wherein the secondary space of the main body is bonded with a plurality of receiving pockets for receiving smaller articles.

6. The luggage having a hidden type pull handle in accordance with claim 1, wherein the pull handle is a one-shaft pull handle.

7. The luggage having a hidden type pull handle in accordance with claim 1, wherein the pull handle is a two-shaft pull handle.

8. The luggage having a hidden type pull handle in accordance with claim 1, wherein the middle partition is provided with a connecting plate made of solid material, and a fixing seat is mounted on the pull handle and is fixed on the connecting plate to position the pull handle in the secondary space of the main body.

9. The luggage having a hidden type pull handle in accordance with claim 1, wherein the wheel seat is made of a fiber reinforced plastic material, and the reinforcement member is made of a fiber reinforced plastic material.

10. The luggage having a hidden type pull handle in accordance with claim 1, wherein the arcuate guard plate is integrally formed with the upright plate.

11. The luggage having a hidden type pull handle in accordance with claim 1, wherein the upright plate has a bottom formed with a pivot slot, and the roller is rotatably mounted in the pivot slot of the wheel seat.

12. The luggage having a hidden type pull handle in accordance with claim 1, wherein the arcuate guard plate of the wheel seat of each of the two roller sets is extended to the outer side of the main space and the secondary space of the main body.

13. The luggage having a hidden type pull handle in accordance with claim 1, wherein the secondary space of the main body has a periphery formed with a first piping, the wheel seat has an inner wall formed with a first insertion groove, and the reinforcement member has an outer wall formed with a second insertion groove combined with the first insertion groove of the wheel seat to form a tubular space for receiving the first piping of the secondary space of the main body.

14. The luggage having a hidden type pull handle in accordance with claim 1, wherein the middle partition of the main body has a periphery formed with a second piping, and the arcuate guard plate has an inner wall formed with a third insertion groove for receiving the second piping of the middle partition of the main body.

15. The luggage having a hidden type pull handle in accordance with claim 1, further comprising two support members each mounted on the bottom of the main body and each located opposite to the respective roller set.

16. The luggage having a hidden type pull handle in accordance with claim 15, wherein each of the two support members includes a base plate mounted on the bottom of the main body, a foot post mounted on the bottom of the base plate, and a front catch plate mounted on a front side of the base plate.

17. The luggage having a hidden type pull handle in accordance with claim 16, wherein the base plate and the foot post are combined with the support plate so as to position each of the two support members on the bottom of the main body.

18. The luggage having a hidden type pull handle in accordance with claim 16, wherein the base plate and the front catch plate encompass the corner of the bottom of the main body so as to protect the bottom of the main body.

19. The luggage having a hidden type pull handle in accordance with claim 1, further comprising a frame mounted in the main space of the main body and connected to the support plate and the connecting plate of the main body for positioning the pull handle.

* * * * *